US005819783A

United States Patent [19]

Blatt et al.

[11] Patent Number: 5,819,783

[45] Date of Patent: Oct. 13, 1998

[54] MODULAR 3-WAY VALVE WITH MANUAL OVERRIDE, LOCKOUT, AND INTERNAL SENSORS

[75] Inventors: John A. Blatt, Grosse Pointe Shores; Wayne D. Morroney, Troy; James J. Acierno, Clinton Township, all of Mich.

[73] Assignee: ISI Norgren Inc., Anoka, Minn.

[21] Appl. No.: 758,591

[22] Filed: Nov. 27, 1996

[51] Int. Cl.[6] ..... F15B 13/043

[52] U.S. Cl. ..... 137/271; 91/443; 91/447; 137/552; 137/554; 137/557; 137/625.64; 137/884

[58] Field of Search ..... 91/443, 447; 137/271, 137/554, 625.64, 884, 557, 552

[56] References Cited

U.S. PATENT DOCUMENTS

| | | | |
|---|---|---|---|
| 3,347,259 | 10/1967 | Lansky et al. | 137/269 |
| 4,000,684 | 1/1977 | Ruffley | 91/443 X |
| 4,075,928 | 2/1978 | Bitonti | 91/447 X |
| 4,227,547 | 10/1980 | Cameron | 137/596.16 X |
| 4,240,467 | 12/1980 | Blatt . | |
| 4,257,455 | 3/1981 | Cameron | 137/596.16 |
| 4,257,572 | 3/1981 | Neff | 137/625.64 X |
| 4,269,225 | 5/1981 | Ruchser et al. | 137/596.16 |
| 4,299,251 | 11/1981 | Dugas . | |
| 4,345,620 | 8/1982 | Ruchser et al. | 137/596.16 |
| 4,376,450 | 3/1983 | Fayfield et al. | 137/554 |
| 4,462,427 | 7/1984 | Neff | 137/884 X |
| 4,465,100 | 8/1984 | Neff | 137/625.64 |
| 4,485,846 | 12/1984 | Neff | 137/625.64 |
| 4,585,029 | 4/1986 | Harding . | |
| 4,590,963 | 5/1986 | Gardner et al. . | |
| 4,596,980 | 6/1986 | Bergeron et al. . | |
| 4,649,957 | 3/1987 | Quinn | 137/625.64 |
| 4,656,400 | 4/1987 | Pailthorp et al. . | |
| 4,659,969 | 4/1987 | Stupak, Jr. . | |
| 4,665,348 | 5/1987 | Stupak, Jr. . | |
| 4,953,590 | 9/1990 | Kakinuma et al. . | |
| 4,970,941 | 11/1990 | Reinhardt | 137/884 X |
| 4,993,684 | 2/1991 | Prina | 137/627.5 X |
| 5,004,014 | 4/1991 | Bender . | |
| 5,086,273 | 2/1992 | Leon . | |
| 5,101,856 | 4/1992 | Kakinuma et al. . | |
| 5,236,012 | 8/1993 | Lin . | |
| 5,244,002 | 9/1993 | Frederick . | |
| 5,257,014 | 10/1993 | Zimmerman . | |
| 5,320,123 | 6/1994 | Corso et al. . | |
| 5,484,352 | 1/1996 | Kuma . | |
| 5,538,037 | 7/1996 | Pizao . | |

OTHER PUBLICATIONS

Loc–Master, Safety Lock Out & Exhaust Air Valves, copyright date 1990.

*Primary Examiner*—Gerald A. Michalsky
*Attorney, Agent, or Firm*—Young & Basile, P.C.

[57] ABSTRACT

An apparatus selectively supplies a source of pressurized fluid to a load device and selectively exhausts pressurized fluid from the load device. The apparatus includes a first housing for defining a longitudinally extending aperture communicating through first, second, and third passages with spaced first, second and third external surface portions of the first housing. A valve spool is engageable within the first aperture for longitudinal movement between a first position communicating the second passage with the third passage and a second position communicating the first passage with the second passage. The valve spool is normally biased toward the first position. Modular port members are connectable to the first, second and third spaced external surface portions for connecting the first passage to a source of pressurized fluid, the second passage to the load device, and the third passage to an exhaust port. If desired, one or more parameters of operation of the valve spool can be monitored to determine if the valve spool has moved completely from the first position to the second position. Signals can be generated corresponding to the monitored parameters of operation, such as pressure and/or position. If desired, a speed control device is positionable on the second external surface portion interposed between the first housing and the modular port member for the second passage for controlling the speed of actuation of the load device.

18 Claims, 6 Drawing Sheets

MODULAR 3-WAY VALVE WITH MANUAL OVERRIDE, LOCKOUT, AND INTERNAL SENSORS

FIELD OF THE INVENTION

The present invention relates to a 3-way solenoid valve having a manual override, a lockout feature and at least one internal sensor for sensing position and/or pressure. The 3-way solenoid operated valve includes a modular configuration allowing the assembly of different size ports to a universal valve housing body. The sensors provide diagnostic information with respect to position and/or pressure of the 3-way valve. An internal volume within the universal main body of the 3-way valve is isolated by a check valve to buffer any pressure variations from the source of pressurized fluid, such as compressed air.

BACKGROUND OF THE INVENTION

Previously known 3-way solenoid operated valves have included a generally monolithic valve body and port structure requiring the manufacture, storage and supply of a specific 3-way valve for the particular application. Any changes in the application during initial installation, or later during production line change over or other modifications to the initial configuration, may require a different size 3-way valve port configuration, thereby requiring a different 3-way solenoid operated valve to be ordered and installed for the particular changed application. This situation required the manufacture of different size valves for various applications, and sufficient storage to maintain an adequate inventory of each size of the 3-way solenoid operated valves to meet customer demand. It would be desirable to reduce the amount of capital tied up in inventory and storage facilities while continuing to adequately meet customer demands for different size ports on a 3-way solenoid operated valve.

In addition, currently known 3-way solenoid operated valves are occasionally subject to failure or fail to perform in the manner intended as a result of pressure fluctuations in the source of pressurized fluid to the solenoid actuator for the 3-way valve, resulting in the 3-way valve failing to move from a first position, such as a closed position, to a second or open position. It would be desirable in the present invention to provide an internally formed pressurized fluid buffer in communication with the solenoid operated valve for the 3-way valve in order to reduce the likelihood of pressure variations and to reduce the amplitude of any pressure variations that do exist while operating the 3-way solenoid operated valve.

Previously known solenoid operated 3-way valves have not included any diagnostic capability, and/or capability to generate a signal corresponding to the position of the 3-way valve or to the pressure of pressurized fluid delivered to the load device. Therefore, it has been impossible to determine if the 3-way valve has been successfully moved from a first position, communicating the load device with an exhaust port, to a second position, communicating the source of pressurized fluid with the load device and isolating the exhaust port. It would be desirable in the present invention to provide diagnostic functions on a solenoid operated 3-way valve. Furthermore, it would be desirable to provide a sensor for determining the position of the 3-way valve to determine if the valve spool has successfully moved from the first position to the second position, or from the second position to the first position. In addition, it would be desirable in the present invention to provide a sensor for determining the pressure of pressurized fluid supplied to the load device through the 3-way valve.

Currently, an adjustable restriction orifice is required at the inlet and outlet ports of a load device, such as a pneumatic or hydraulic actuator, in order to control the speed of actuation in either direction. It would be desirable in the present invention to provide means for controlling the movement of the load device, or more particularly the speed of movement of the load device when supplying fluid pressure to the load device or while removing fluid pressure from the load device. It would also be desirable to achieve this control function at a position adjacent to the 3-way valve.

SUMMARY OF THE INVENTION

The present invention provides modular port members in various sizes and connection configurations that can be assembled as desired to various surfaces of the universal valve spool housing or body. The present invention also can provide an enlarged chamber formed in the valve spool housing to define an internal volume for suppressing pressure fluctuations from the source of pressurized fluid. One or more sensors can also be provided in the present invention to enable diagnostic functions, preferably including at least one of a position sensor for generating a signal corresponding to the valve spool in the first position and the second position and/or a pressure sensor for generating a signal corresponding to the measured pressure of pressurized fluid supplied to the load device through the 3-way valve. In addition, the present invention can optionally provide means for controlling the speed of actuation of the load device when connected to a source of pressurized fluid through the 3-way valve, or while connected to an exhaust port through the 3-way valve.

The apparatus according to the present invention selectively supplies a source of pressurized fluid to a load device and selectively exhausts pressurized fluid from the load device. The apparatus can include a generally rectangular-shaped first housing having a first longitudinally extending aperture communicating through first, second and third passages with spaced first, second and third portions respectively of an external surface of the first housing. The first housing can also include an enlarged chamber formed therein defining an internal volume for suppressing pressure fluctuations from the source of pressurized fluid, if desired. Modular port members are individually connectable to the first, second and third spaced portions of the external surface of the first housing for connecting the first passage to a source of pressurized fluid, for connecting the second passage to the load device, and for connecting the third passage to an exhaust port. A valve spool is engageable within the first aperture of the first housing. The valve spool is longitudinally movable within the first aperture between a first position to place the second passage in communication with the third passage and a second position to place the first passage in communication with the second passage. Biasing means is provided for urging the valve spool toward the first position.

A second housing is connectable to the first housing and has a second longitudinally extending aperture disposed coaxially aligned with the first aperture of the first housing. A piston is connectable to the valve spool and engageable within the second aperture of the second housing for driving the valve spool for the first position toward the second position. The piston defines an expandable chamber between the piston and the second housing. The piston has a first periphery and a second periphery defining an annular shoulder. A position sensor can be supported by the second housing adjacent the shoulder of the piston for sensing the first periphery and the second periphery as the piston moves the valve spool between the first position and the second position. The position sensor generates a signal corresponding to the sensed position of the piston or valve spool. A solenoid operated valve is supportable on the second housing and in communication with the source of pressurized fluid.

A pressure sensor can be supported by the second housing for sensing pressure of the pressurized fluid in the second passage of the first housing to determine if the piston has moved the valve spool from the first position to the second position. The pressure sensor generates a signal corresponding to the sensed pressure of the pressurized fluid supplied to the load device.

A manual override can be provided for placing the source of pressurized fluid in communication with the expandable chamber to drive the piston and connected valve spool from the first position toward the second position. The manual override can be disposed between the solenoid operated valve and the expandable chamber defined by the piston and the second housing. A lockout valve spool can also be provided within the second housing. The lockout valve spool can be disposed between the manual override and the expandable chamber defined by the piston and the second housing. The lockout valve spool is moveable between a first position allowing fluid communication between the source of pressurized fluid and the expandable chamber, and a second position preventing fluid communication between the source of pressurized fluid and the expandable chamber while exhausting fluid pressure from the expandable chamber.

It is desirable in the present invention to actuate or move the 3-way valve spool as rapidly as possible between the first and second position to reduce the possibility of the valve spool becoming stuck in between the first and second positions allowing direct communication between the first, second and third modular ports. When in this intermediate position, the valve spool essentially allows the source of pressurized fluid to communicate directly with the exhaust port. However, it is undesirable in certain applications to apply the full force from the source of pressurized fluid directly to the load device without regulating the speed at which the load device operates. Therefore, it is desirable in the present invention to provide means for controlling the actuation speed of the load device and/or the rate of application of the source of pressurized fluid to the load device independently of the speed of actuation of the valve spool for the 3-way valve.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
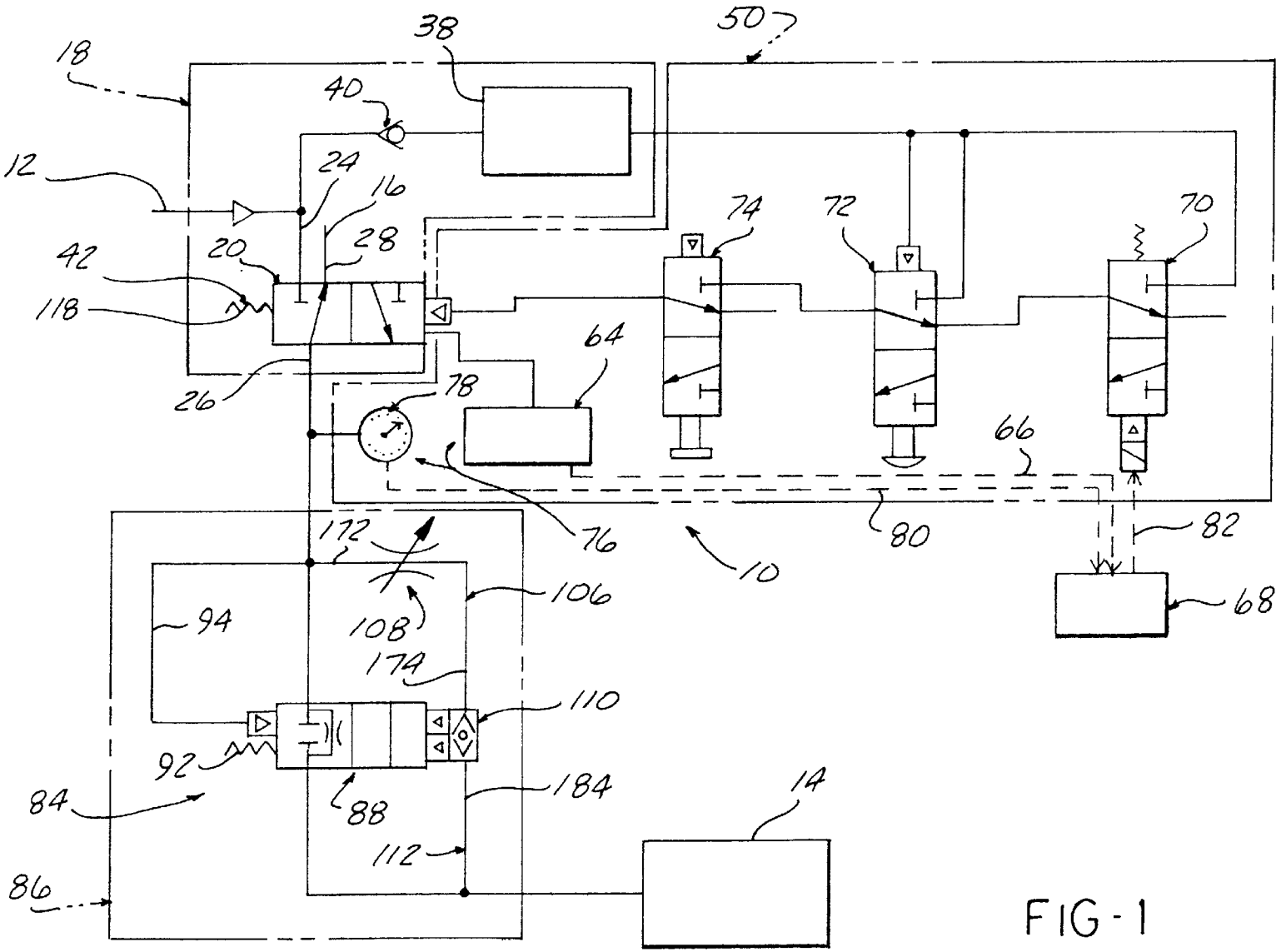
FIG. 1 is a simplified schematic view of an apparatus according to the present invention for selectively supplying a source of pressurized fluid to a load device and for selectively exhausting pressurized fluid from the load device, including optional means for controlling the speed of actuation of the load device.
Figure 2:
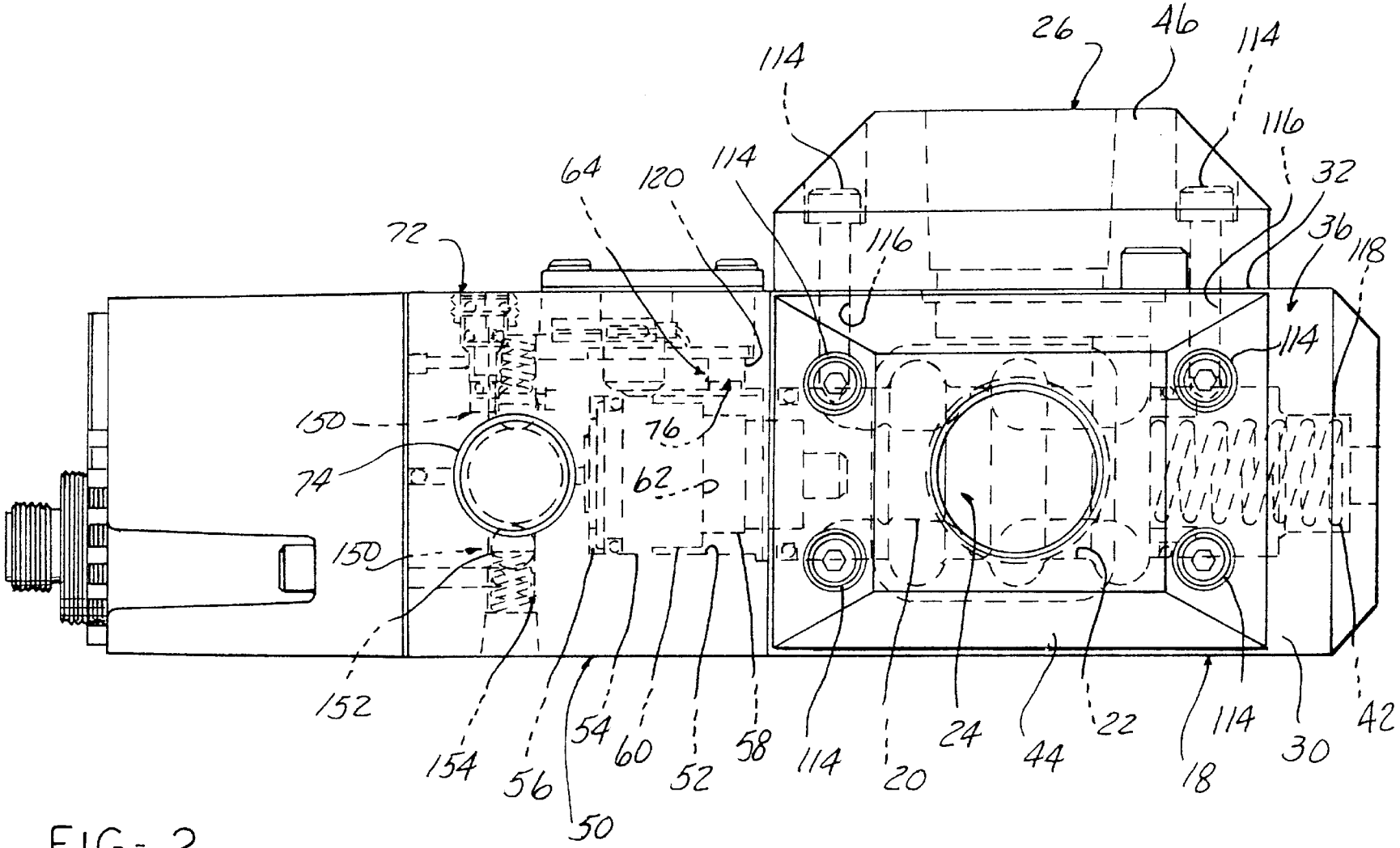
FIG. 2 is a side elevational view of a solenoid operated 3-way valve with a valve spool in a first position normally closing a first port in communication with a source of pressurized fluid and normally opening a second port connected to the load device to allow communication with a third port for exhausting pressurized fluid from the load device.
Figure 8:
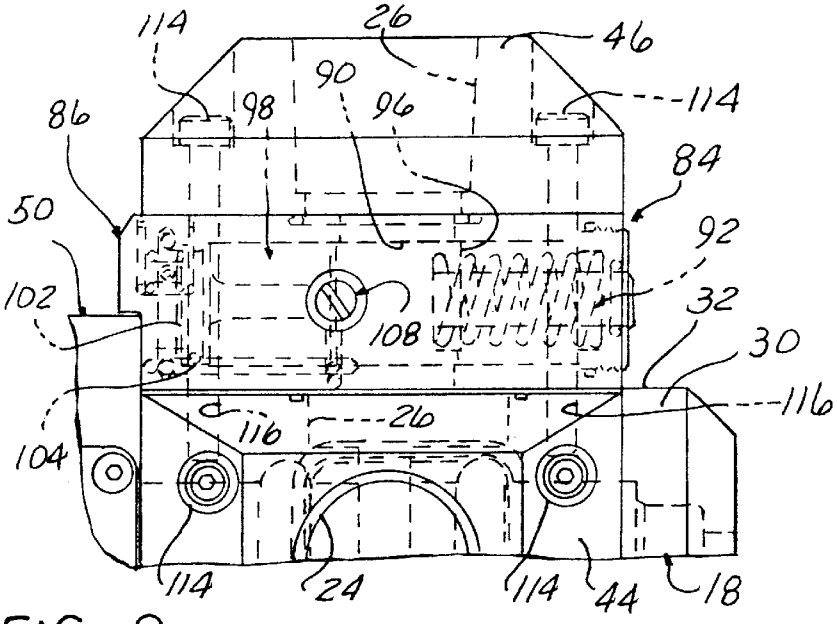
FIG. 8 is a plan view of the solenoid operated 3-way valve according to the present invention with an optional modular means connected between the valve housing and the modular second port for controlling the speed of the load device when connected to a source of pressurized fluid and when connected to an exhaust port with a control valve spool shown in a first position substantially closing fluid communication between the second port and the first housing.
Figure 11:
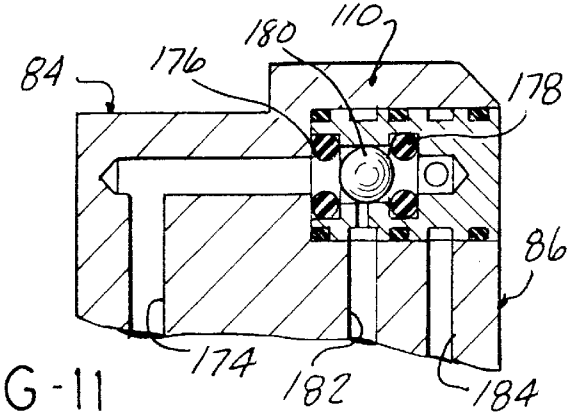
FIG. 11 is a detail view of the shuttle ball check disposed within the speed control means according to the present invention.

An apparatus 10 according to the present invention as illustrated in simplified schematic form in FIG. 1 selectively supplies a source of pressurized fluid 12 to a load device 14 and selectively exhaust pressurized fluid from the load device 14 through an exhaust port 16. First housing means 18 is provided for enclosing a 3-way valve spool 20. The first housing means includes a first longitudinally extending aperture 22 communicating through first, second and third passages, 24, 26 and 28 respectively, with spaced first, second and third portions, 30, 32 and 34 respectively, of an external surface 36 of the first housing means 18 as best seen in FIG. 2. Referring again to FIG. 1, the first housing means 18 can include an enlarged chamber 38 formed therein defining an internal volume communicating with the source of pressurized fluid 12 through check valve 40 for suppressing pressure fluctuations from the source of pressurized fluid 12. The valve spool 20 is engageable within the first aperture 22 of the first housing means 18 and is longitudinally movable therein between a first position illustrated in FIG. 2 to place the second passage 26 in communication with the third passage 28 while isolating the first passage 24, and a second position illustrated in FIG. 3 to place the first passage 24 in communication with the second passage 26 while isolating the third passage 28. When in the first position, or normally closed position illustrated in FIG. 1, the valve spool 20 isolates the load device 14 from the source of pressurized fluid 12, while communicating the load device 14 with the exhaust port 16. Biasing means 42 is provided for urging the valve spool 20 toward the first position. As best seen in FIGS. 4 and 8, first, second and third modular ports 44, 46 and 48 respectively are connectable to the first, second and third spaced portions 30, 32 and 34 respectively of the external surface 36 of the first housing means 18 for connecting the first passage 24 to the source of pressurized fluid 12, for connecting the second passage 26 to the load device 14, and for connecting the third passage 28 to the exhaust port 16. The modular ports allow connection of different size fittings to the universal first housing means 18. The modular ports, by way of example and not limitation, can be provided with one-half inch diameter openings, three-quarter inch diameter openings, or one inch diameter openings, and can be provided with internal threading if desired, or with any other type of pipe connection required for the particular application.

Second housing means 50 is connectable to the first housing means 18 and has a second longitudinally extending aperture 52 coaxially aligned with the first aperture 22 of the first housing means 18 as best seen in FIGS. 2 and 4. A piston 54 is connectable to the valve spool 20 and engagable in the second aperture 52 of the second housing means 50 for driving the valve spool 20 from the first position toward the second position. The piston 54 defines an expandable chamber 56 best seen in FIG. 3 between the piston 54 and the second housing means 50. The piston 54 preferably includes a first periphery 58 and a second periphery 60 defining an annular shoulder. Position sensing means 64 is supported by the second housing means 50 adjacent the shoulder 62 of the piston 54 for sensing the first periphery 58 or the second periphery 60 as the piston 54 moves the valve spool 20 between the first position and the second position. The position sensing means 64 generates a signal 66 corresponding to the sensed position of the piston 54 which corresponds to the position of the valve spool 20. The position signals 66 can be transmitted to control means 68 for further processing in accordance with a program stored in memory or for recording. The control means 68 may process or record numerous signals from a number of individual apparatus 10 according to the present invention, or may process or record information signals from a single apparatus 10 according to the present invention. The control means 68 may also include a large area network receiving, processing and/or recording information signals from an entire production line.

Referring to FIGS. 1 and 4, solenoid operated valve means 70 is supportable on the second housing means 50 and is in communication with the source of pressurized fluid 12. The solenoid operated valve means 70 can be in communication with the source of pressurized fluid 12 through the enlarged chamber 38. The solenoid operated valve means 70 selectively controls application of the source of pressurized fluid 12 to the expandable chamber 56 to move the piston 54 and connected valve spool 20 from the first position to the second position against the urging of the biasing means 42. The solenoid operated valve means 70 also selectively exhausts pressurized fluid from the expandable chamber 56 for permitting the biasing means 42 to drive the valve spool 20 from the second position toward the first position.

Manual override means 72 can communicate the source of pressurized fluid 12 with the expandable chamber 56 to drive the piston 54 and connection valve spool 20 from the first position toward the second position independent of the solenoid operated valve means 70. The manual override means 72 is preferably disposed between the solenoid operated valve means 70 and the expandable chamber 56. Lockout valve spool means 74 is engagable within the second housing means 50. Preferably, the lockout valve spool means 74 is disposed between the manual override means 72 and the expandable chamber 56. The lockout valve spool means 74 is moveable between a first position for allowing fluid communication between the source of pressurized fluid 12 and the expandable chamber 56, and a second position for preventing fluid communication between the source of pressurized fluid 12 and the expandable chamber 56 while exhausting fluid pressure from the expandable chamber 56. The lockout valve spool means 74 is schematically illustrated in the second position in FIG. 1, and would be moved to the first position for allowing operation of the 3-way valve spool 20 in response to the application of fluid pressure through solenoid operated valve means 70 or manual override means 72.

Sensing means 76 can be provided for measuring at least one parameter corresponding to operation of the valve spool 20 to determine if the valve spool 20 has moved completely from the first position to the second position. The sensing means 76 generates a signal corresponding to the sensed parameter of operation. The sensing means 76 can include position sensing means 64 for determining the position of the valve spool 20 as the valve spool 20 moves between the first and second position. The position sensing means 64 can generate a signal 66 corresponding to the position of the valve spool 20. In the alternative, or in addition, the sensing means 76 can include pressure sensing means 78 for measuring the pressure of the pressurized fluid in the second passage 26 of the first housing means 18 to determine if the valve spool 20 has moved completely from the first position to the second position. The pressure sensing means 78 can generate a signal 80 corresponding to the sensed pressure of the pressurized fluid supplied to the load device 14. Preferably, the position signal 66 is converted into digital form for transmittal to the control means 68. Preferably, the pressure signal 80 is transmitted to the control means 68 as an analog signal. The control means 68 can provide an actuation signal 82 to operate the solenoid operated valve means 70 based on a control program stored in memory and the measured operational parameters collected and transmitted to the control means 68.

Referring now to FIGS. 1 and 8–11, speed control means 84 can be provided, if desired, for controlling the speed of actuation of the load device 14. The optional speed control means 84 can be positioned between the first housing means 18 and the second modular port 46 as best seen in FIG. 8. The speed control means 84 can include third housing means 86 for enclosing a variable orifice valve means 88. The third housing means 86 includes a third longitudinally extending aperture 90. The variable orifice valve means 88 is reciprocally received within the third longitudinally extending aperture 90 for movement between a first position (shown in FIGS. 1 and 8) substantially closing fluid communication between the second passage 26 and the second modular port 46, and a second position (shown in FIG. 9) for substantially opening fluid communication between the second passage 26 and the second modular port 46. Biasing means 92 is provided for urging the variable orifice valve means 88 toward the first position. A fluid passage 94 is provided to communicate the second passage 26 with a reduced cross sectional portion, such as annular shoulder 96 of the variable orifice valve means 88. The fluid passage 94 assists the biasing means 92 in urging the variable orifice valve means 88 toward the first position when the source of fluid pressure 12 is in communication with the second passage 26 through the valve spool 20, when the valve spool 20 is in the second position. The second passage 26 also communicates with a first chamber 98 formed between the variable orifice valve means 88 and the third longitudinally extending aperture 90. A second expandable chamber 100 is also defined between the variable orifice valve means 88 and the third longitudinally extending aperture 90 formed in the third housing means 86. The second expandable chamber 100 is defined in part by a piston portion 102 of the variable orifice valve means 88 and includes a seal ring 104 about the outer periphery of the piston portion 102 to fluidly seal the first chamber 98 from the second chamber 100 for reasons which will become clear when reference is made to the description of the operation of the variable orifice valve means 88 below. The second passage 26 also is connectable in fluid communication with the second expandable chamber 100 through fluid passage 106 including a variable valve means 108 for adjusting the rate of fluid flow into the second expandable chamber 100 for controlling the speed or rate that the second expandable chamber 100 expands to drive the variable orifice valve means 88 from the first position toward the second position. The fluid passage 106 also preferably passes through a shuttle check valve means 110 capable of movement between a first position isolating the fluid passage 106 from communication with the second expandable chamber 100 and a second position allowing fluid communication between the fluid passage 106 and the expandable chamber 100. A third fluid passage 112 is in fluid communication with the load device 114 and the shuttle check valve means 110, such that when the shuttle check valve means 110 is in the second position, fluid communication through the third fluid passage 112 is prevented and when in the first position fluid communication is permitted through the third fluid passage 112 between the load device 14 and the second expandable chamber 100. In this manner, when initially applying the source of pressurized fluid 12 to the second passage 26, the rate of fluid communication with the load device 14 is controlled through the rate or speed of opening of the variable orifice valve means 88 in response to a controlled rate of expansion of expandable chamber 100 as the source of pressurized fluid 12 passes through the fluid passage 106 including variable valve means 108 and shuttle check valve means 110. This effectively controls the speed of actuation of the load device 14 in relation to the setting of flow through the variable valve means 108, such as a needle valve. The second fluid passage 106 is maintained in fluid communication with the expandable chamber 100 until the valve spool 20 moves from the second position to the first position. After movement of the valve spool 20 to the first position, a pressure differential develops between the effective pressure in second fluid passage 106 and third fluid passage 112. The shuttle check valve means 110 in response to this pressure differential moves from the second position to the first position blocking fluid communication between the second fluid passage 106 and the expandable chamber 100 and allowing fluid communication between the third fluid passage 112 and the expandable chamber 100. This maintains the variable orifice valve means 88 in the open position while exhausting fluid pressure from the load device 14, and only permits movement of the variable orifice valve means 88 from the second position to the first position in response to the biasing means 92 after the combined force of the biasing means 92 and the fluid pressure acting on the reduced cross sectional area 96 can overcome the force supplied to the piston portion 102 through the third fluid passage 112. This generally corresponds to an equalization of pressure between the second fluid passage 106 and the third fluid passage 112 of the third housing means 86 before the variable orifice valve means 88 reaches the first position. This completes the cycle of the speed control means 84 placing the speed control means 84 in proper position for subsequent movement of the valve spool 20 from the first position to the second position.

Figure 3:
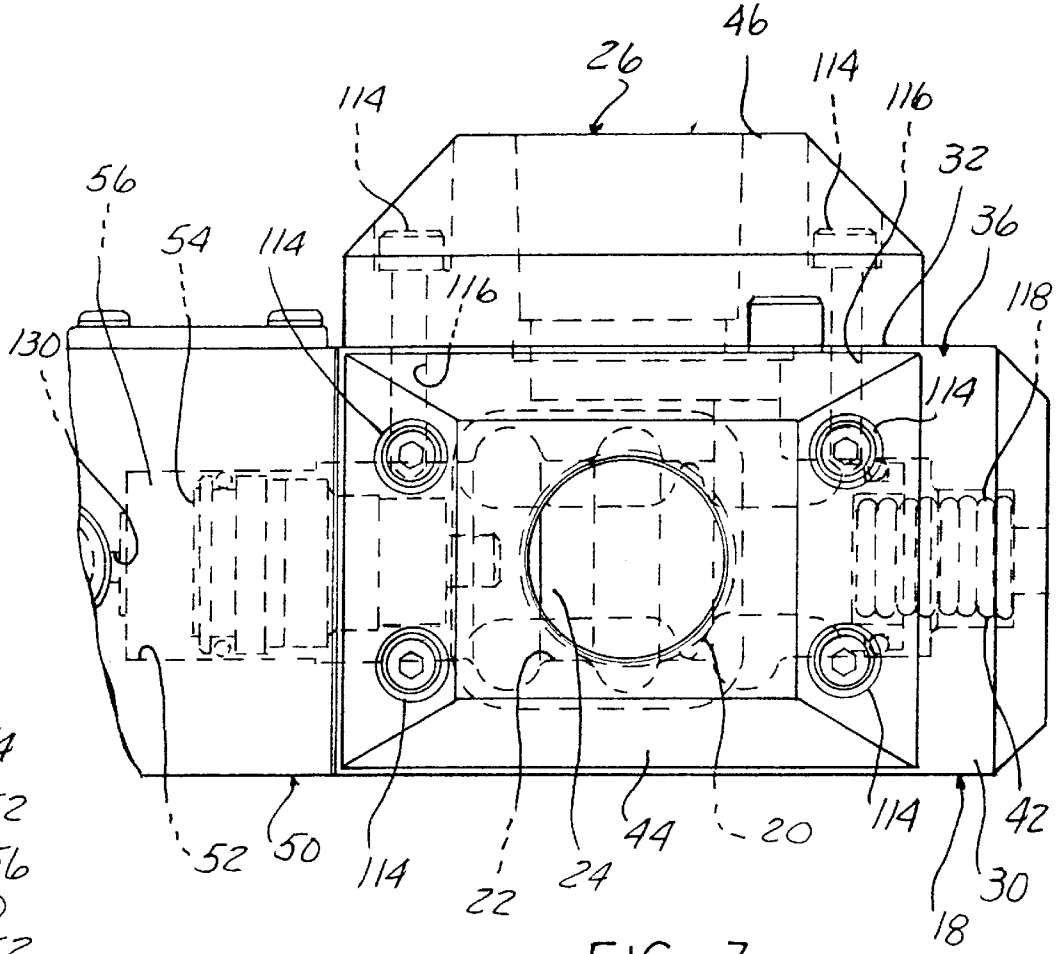
FIG. 3 is a detail view of the 3-way valve according to the present invention in a second position isolating the third port and placing the first and second ports in communication with one another.
Figure 4:
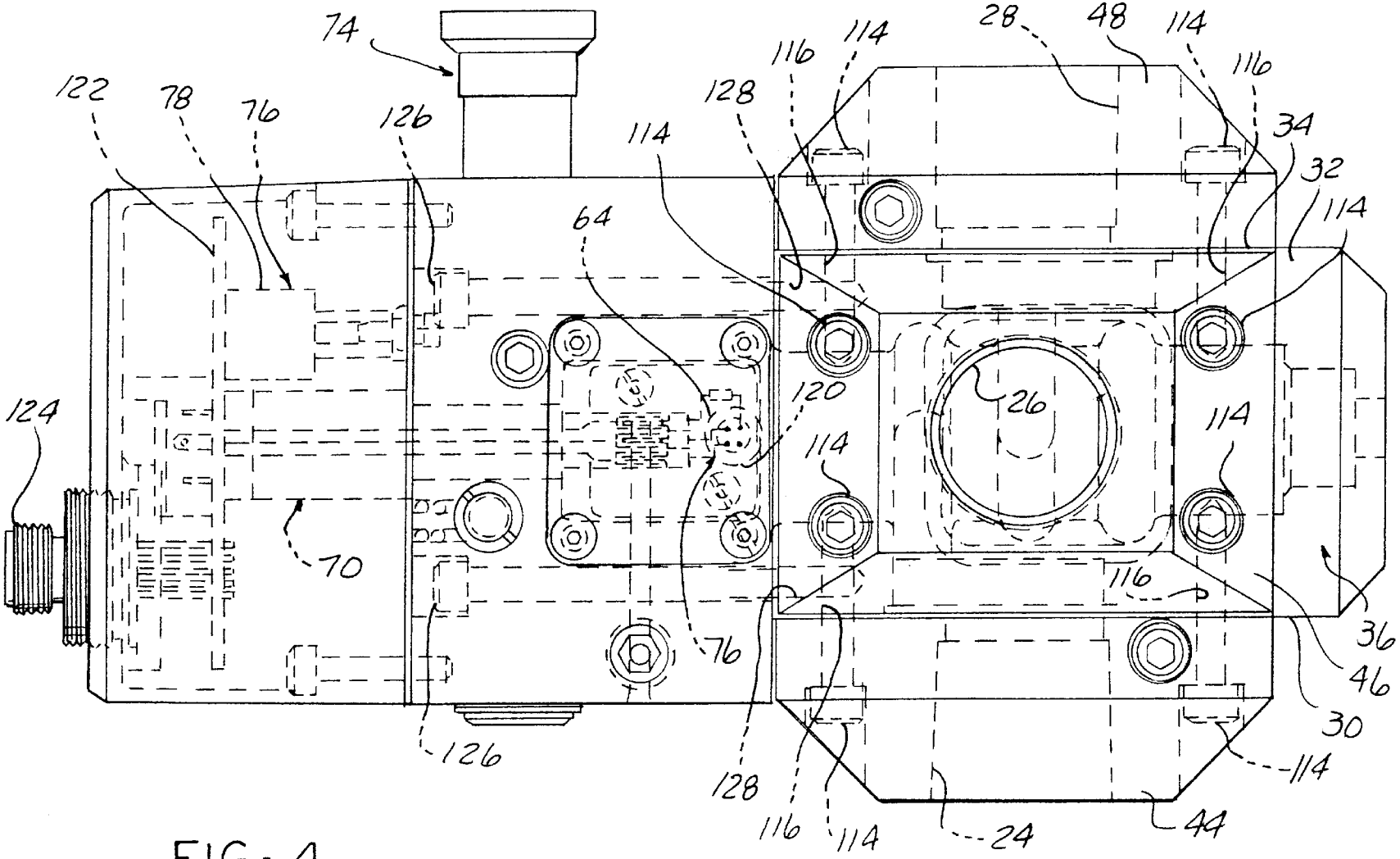
FIG. 4 is a plan view of the modular solenoid operated 3-way valve according to the present invention illustrated in FIG. 1.

Referring now to FIGS. 2–4, the apparatus 10 according to the present invention is illustrated to disclose various advantageous structural configurations and details. Various portions of the apparatus 10 are not illustrated, or have been simplified in these views for purposes of clarity. The source of pressurized fluid can be supplied through the first modular port 44 to the first passage 24 of the first housing means 18. With the valve spool 20 in the first position as illustrated in FIG. 2, the source of pressurized fluid is isolated from the second passage 26 and third passage 28. The first modular port 44 is connectable to the first portion 30 of the external surface 36 of the housing means 18. The third modular port 48 is connectable to the first housing means 18 by connection to the third portion 34 of the external surface 36. Any suitable means for connecting the modular ports 44, 46 and 48 to the first housing means 18 can be used. As illustrated, the modular ports 44, 46 and 48 are connected with a plurality of threaded fasteners 114 engagable within threaded apertures 116 formed in the first housing means 18. The modular ports 44, 46 and 48 are readily interchangeable with one another and are available in a variety of sizes, such as one-half inch diameter through one inch diameter openings. The modular ports 44, 46 and 48 can also be supplied with various piping connections as desired for the particular installation. For purposes of illustration, the modular ports 44, 46 and 48 are illustrated with pipe thread. The biasing means 42, such as compression spring 118 biases the valve spool 20 toward the first position illustrated in FIG. 2. The valve spool 20 may include a piston portion integrally formed therewith, or may have a piston 54 connectable thereto for driving the valve spool 20 between the first position illustrated in FIG. 2 to the second position illustrated in FIG. 3.

Preferably, the piston 54 has a first periphery 58 and a second periphery 60 defining an annular shoulder 62. The first and second periphery 58 and 60 of the piston 54 are positioned adjacent the sensing means 64, so that the position sensing means 64 can generate a position signal 66 corresponding to the valve spool 20 in the first position and the second position. The first and second periphery 58 and 60 define axially spaced, distinct target surfaces formed on the piston and associated with the spool. Each of the target surfaces has a distinctive outer diameter. Preferably, each target surface is a light reflective surface. The position sensing means 64 can include a light emitter for transmitting a light beam in the detecting field toward the piston or spool. The position sensing means 64 can include a detector 120 for detecting the light beam reflected off from a target surface. The detector 120 generates an output signal of a magnitude proportional to the amount of light reflected from the target surface. An intermediate, non-target surface may be formed between to adjacent target surfaces. The output signal 66 from the detector 120 can be input into a controller to compare the magnitude of the output signal with prestored values corresponding to the amount of light reflected off from a target surface in each distinct valve spool position. The controller on the basis of this comparison is able to determine the exact position of the valve spool as the valve spool shifts between the first and second position within the valve body. The position signal 66 can be directed through a circuit board 122 to convert the signal 66 from analog to digital format, if desired.

An electrical connector 124 can provide both signal and power connections for the apparatus 10. The power supply through the electrical connector 124 can be controlled to selectively operate the solenoid operated valve means 70 to drive the valve spool 20 between the first and second position. In addition, the electrical connector 124 can carry a signal from the pressure sensing means 78 in analog or digital format to a local or remote control means 68 shown schematically in FIG. 1. Preferably, the solenoid operated valve means 70, position sensing means 64 and pressure sensing means 78 are supported from the second housing means 50 connectable to the first housing means 18 to form a coaxial longitudinally extending aperture between the first housing means 18 and second housing means 50 to receive the valve spool 20 and connected piston 54. The second housing means 50 can be connected to the first housing means 18 by any suitable fasteners, such as threaded fasteners 126 engageable within threaded aperture 128 formed in the first housing means 18 as best seen in FIG. 4.

Figure 7:
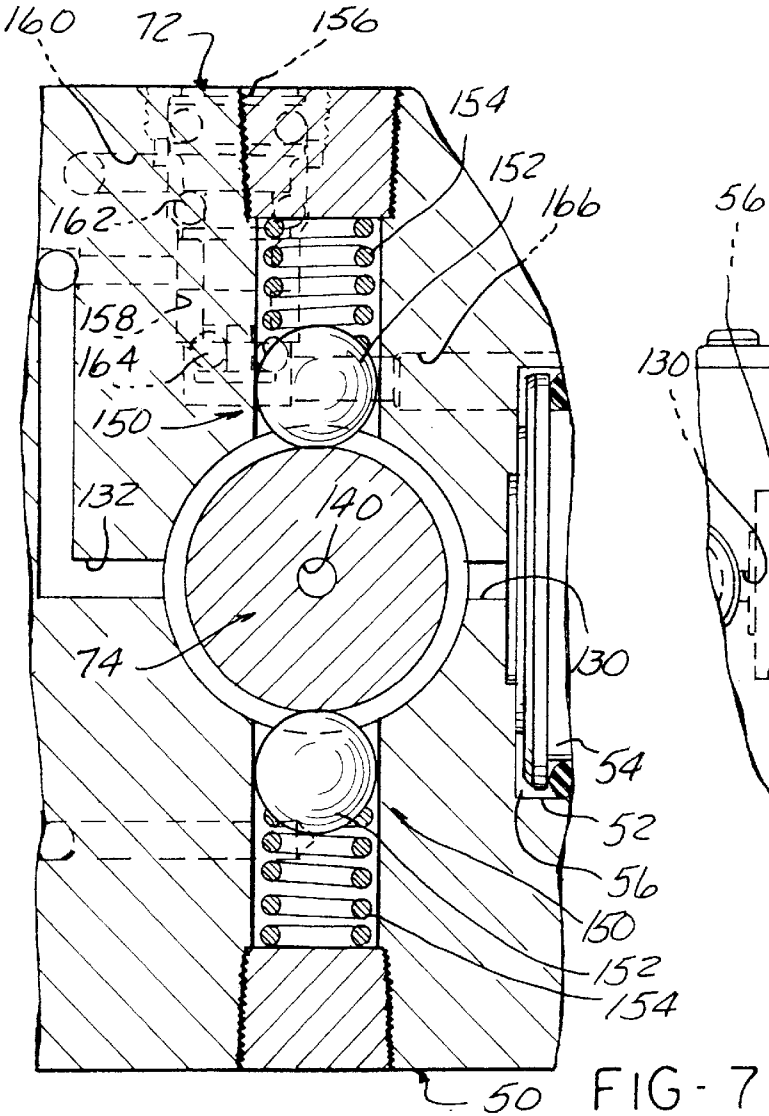
FIG. 7 is a detailed cross sectional view of the lockout valve spool and a manual override according to the present invention.
Figure 6:
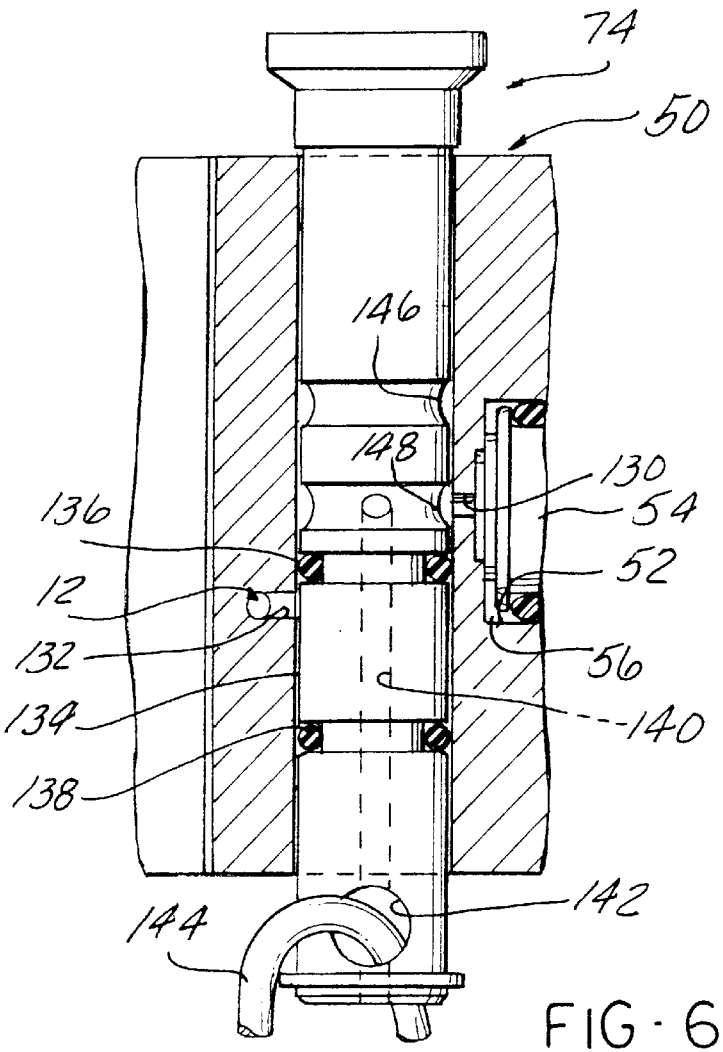
FIG. 6 is a detailed view of the lockout valve spool of FIG. 5 in a second position preventing communication between the source of pressurized fluid and the expandable chamber.
Figure 5:
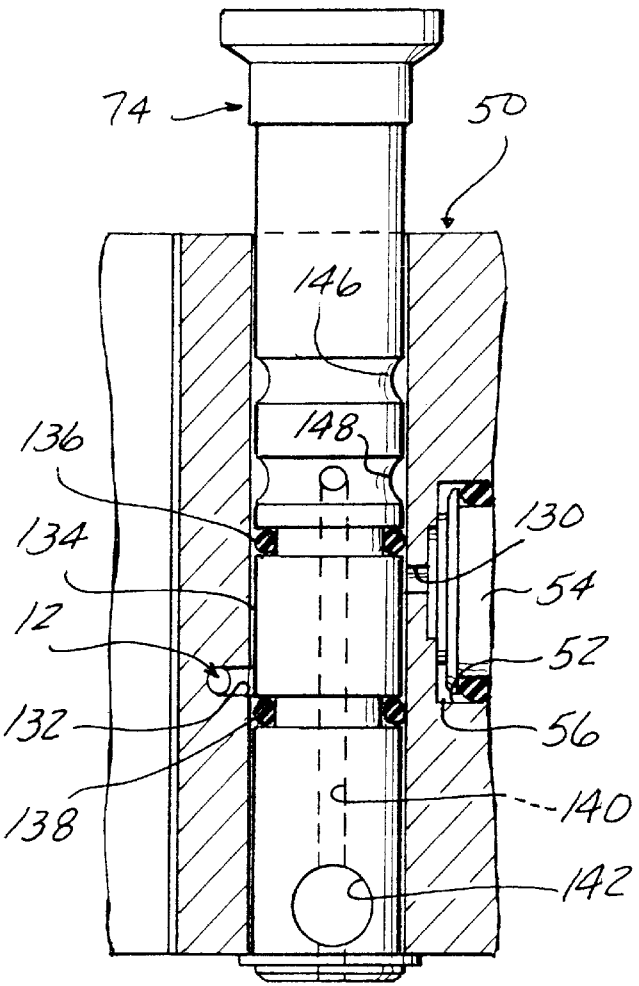
FIG. 5 is a detail view of a lockout valve spool in a first position allowing communication between a source of pressurized fluid and an expandable chamber to drive the 3-way valve spool from the first position to the second position.
Figure 9:
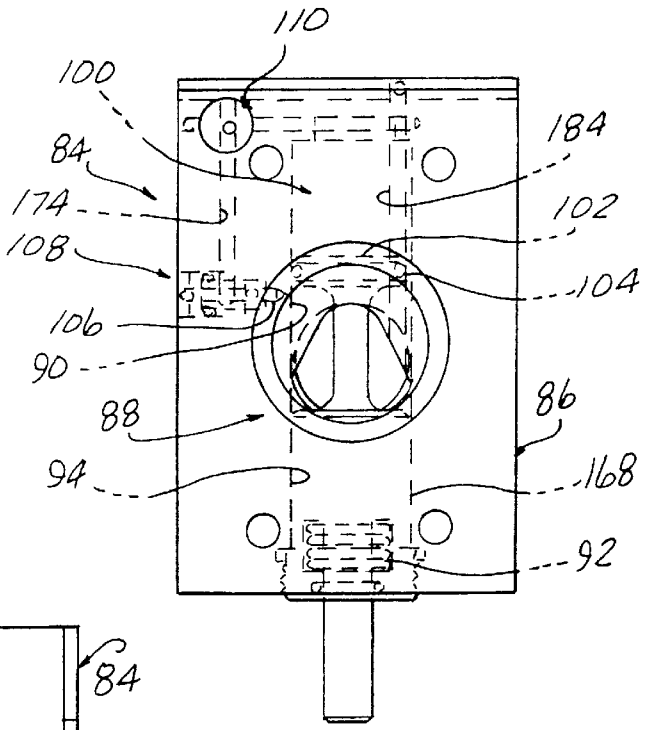
FIG. 9 is a side elevational view of the speed control means illustrated in FIG. 8 with the control valve spool in a second position substantially opening communication between the second modular port and the first housing.
Figure 10:
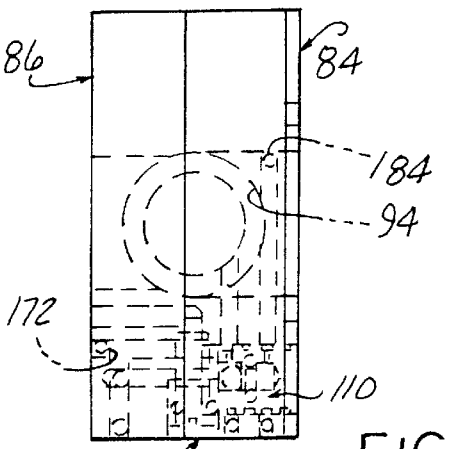
FIG. 10 is an end view of the speed control means according to the present invention.

Referring now to FIGS. 2–7, the expandable chamber 56 defined by the piston 54 as it moves within the second aperture 52 of the second housing means 50 communicates with the source of pressurized fluid 12 through various passages including passage 130 communicating with the expandable chamber 56. As best seen in FIGS. 5 and 6, passage 130 communicates with passage 132 around the outer periphery 134 of the lockout valve means 74 between the first and second annular seal rings 136 and 138 when the lockout valve means 74 is in the first position illustrated in FIG. 5. When the lockout valve means 74 is moved from the first position of FIG. 5 to the second position of FIG. 6, the outer periphery 134 defined between the first and second annular seal rings 136 and 138 is moved axially so that the passages 130 and 132 open adjacent an unsealed position of the outer periphery of the lockout valve means 74. An exhaust passage 140 is provided through the lockout valve means 74 to exhaust any pressure from passages 130 and 132. An aperture 142 is formed adjacent one end of the lockout valve means 74 for receiving a lock member 144 to maintain the lockout valve means 74 in the second position until the lock member 144 is unlocked and removed from the aperture 142 allowing manual manipulation of the lockout valve means 74 from the second position illustrated in FIG. 6 back to the first position illustrated in FIG. 5. The lockout valve means 74 also includes radially inwardly extending first and second spaced annular grooves 146 and 148. The first and second axially spaced annular grooves 146 and 148 define detents to hold the lockout valve means 74 in the first and second positions when engaged by one or more spring biased projections 150 best seen in FIG. 7. The spring biased projections 150 can include a spherical ball 152 urged radially inward toward the lockout valve means 74 by a compression spring 154 as best seen in FIG. 7. As the lockout valve means of 74 is moved between the first and second positions illustrated in FIGS. 5 and 6, the spherical ball 152 moves from engagement with one of the first and second annular grooves 146 or 148 into engagement with the other annular groove to hold the lockout valve means 74 in the new position.

As best seen in FIG. 7, the manual override means 72 includes a reciprocal valve member 156 disposed within an aperture 158 for movement between a first position illustrated in FIG. 7 allowing communication between passage 132, communicating with the lockout valve means 74, and passage 160 communicating from the solenoid operated valve means 70 by passing between annular seal ring 162 and the side wall defining the aperture 158. When the valve member 156 is pushed inwardly with respect to aperture 158, annular seal ring 162 engages the side wall defining aperture 158 to seal passage 160 connected to the solenoid operated valve means 70 from the passage 132 leading to the lockout valve means 74. Simultaneously as the manual override means 72 is pushed inwardly within aperture 158, second annular seal ring 164 disengages from the side walls defining the aperture 158 in order to allow communication between passage 166 connected to the source of pressurized fluid 12 and the passage 132 leading to the lockout valve means 74. The pressure within passage 166 normally urges the reciprocal valve member 156 toward the first position thereby closing fluid communication between passage 166 and passage 132 until the reciprocal valve member 156 is moved axially inwardly with respect the aperture 158 formed in the second housing means 50.

Referring now to FIGS. 8–11, optional speed control means 84 can be connected between the second portion 32 of the external surface of the first housing means 18 and the second modular port 46 as best seen in FIG. 8. The speed control means 84 can include third housing means 86 having a variable orifice valve means 88 moveable between a first substantially closed position illustrated in FIG. 8 and a second substantially open position illustrated in FIG. 9. The variable orifice valve means 88 is reciprocally disposed in a third longitudinally extending aperture 90 formed in the third housing means 86. Biasing means 92 normally urges the variable orifice valve means 88 toward the first position. When in the first position, the variable orifice valve means 88 substantially closes fluid passage 94. Even in the substantially closed position, the variable orifice valve means 88 allows some flow to leak from the second passage 26 of the first housing means 18 through the first chamber 98 to the load device 14. In addition, fluid pressure is allowed to flow in the interstial space 168 between the variable orifice valve means 88 and the third aperture 90 and the third housing means 86 to act against the reduced cross sectional area 96 to assist the urging of the biasing means 92. Passage 172 conducts pressurized fluid from the second passage 26 through the variable valve means 108 such as a needle valve, and continues through passage 174 to shuttle check valve means 110 best seen in FIG. 11. First and second seals 176 and 178 are disposed on opposite sides of a shuttle check ball 180 selectively movable between a first position engaging the first seal 176 and a second position engaging the second seal 178. The shuttle check ball 180 allows fluid communication between passage 174 and passage 182 leading to the second expandable chamber 100 defined between the piston portion 102 and the side wall defining the third longitudinally extending aperture 90 in a third housing means 86 when in the first position while isolating passage 184 in communication with load device 14. When in the second position, the shuttle check ball 180 isolates passage 174 while allowing fluid communication between the load device 14 connected through passage 184 with the second expandable chamber 100 through passage 182. This arrangement permits the control of the rate of actuation of the load device 14 by appropriate setting of the variable valve means 108 to control the speed of actuation and movement of the variable orifice valve means 88 between the first and second positions, while maintaining the variable valve means 88 in the second position while exhausting fluid pressure from the load device 14 through the second passage 26 to the third passage 28 of the first housing means 18. When the fluid pressure in passages 174, 182 and 184 reach equilibrium, the shuttle check ball 180 may move to a neutral position (shown in FIG. 11.) between the first and second position until fluid pressure is applied through passage 174 driving the shuttle check ball 180 to the first position. The biasing means 92 is selected to have sufficient force to move the variable orifice valve means 88 from the second position toward the first position as the fluid pressure drops in the passage 184 from the load device 14 as a corresponding pressure drop occurs in the second expandable chamber 100.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for selectively supplying a source of pressurized fluid to a load device and for selectively exhausting pressurized fluid from the load device comprising:

first housing means for defining a first longitudinally extending aperture communicating through first, second, and third passages with spaced first, second and third portions respectively of an external surface of the first housing means;

a valve spool engageable within the first aperture of the first housing means and longitudinally moveable therein between a first position communicating the second passage with the third passage and a second position communicating the first passage with the second passage;

means for basing the valve spool toward the first position;

modular port means connectable to the first, second and third spaced portions of the external surface of the first housing means for connecting the first passage to the source of pressurized fluid, for connecting the second passage to the load device, and for connecting the third passage to an exhaust port; and speed control means for controlling a speed of movement of the load device independently of a speed of actuation of the valve spool, while supplying fluid pressure to the load device and while removing fluid pressure from the load device, the speed control means disposed between the modular port means and the first housing means.

2. The apparatus of claim 1 further comprising:

means for monitoring at least one parameter corresponding to operation of the valve spool to determine if the valve spool has moved completely from the first position to the second position, the sensing means for generating a signal corresponding to the sensed parameter of operation.

3. The apparatus of claim 1 further comprising:

pressure sensing means for measuring pressure of the pressurized fluid in the second passage of the first housing means to determine if the valve spool has moved from the first position to second position, the pressure sensing means for generating a signal corresponding to the sensed pressure of the pressurized fluid supplied to the load device.

4. The apparatus of claim 1 further comprising:

position sensing means disposed adjacent the valve spool for sensing the valve spool in the first position and second position, the position sensing means for generating a signal corresponding to the sensed position.

5. The apparatus of claim 1 further comprising:

the first housing means including an enlarged chamber formed therein defining an internal volume for suppressing pressure fluctuations from the source of pressurized fluid.

6. The apparatus of claim 1 further comprising:

second housing means connectable to the first housing means for defining a second longitudinally extending aperture coaxially aligned with the first aperture of the first housing means;

a piston connectable to the valve spool and engageable within the second aperture of the second housing means for driving the valve spool from the first position toward the second position, the piston defining an expandable chamber between the piston and the second housing means; and valve means supportable on the second housing means and in communication with the source of pressurized fluid, the valve means for selectively controlling application of the source of pressurized fluid to move the valve spool from the first position to the second position, and for selectively exhausting pressurized fluid for permitting the biasing means to drive the valve spool from the second position toward the first position.

7. The apparatus of claim 1 wherein the speed control means further comprises:

shuttle ball check means for selectively switching between a first position and a second position in response to fluid pressure to control the speed of actuation of the load device during application of pressurized fluid to the load device and during evacuation of pressurized fluid from the load device.

8. An apparatus for selectively supplying a source of pressurized fluid to a load device and for selectively exhausting pressurized fluid from the load device comprising:

first housing means for defining a first longitudinally extending aperture communicating through first, second, and third passages with spaced first, second and third portions respectively of an external surface of the first housing means;

a valve spool engageable within the first aperture of the first housing means and longitudinally moveable therein between a first position communicating the second passage with the third passage and a second position communicating the first passage with the second passage;

means for biasing the valve spool toward the first position; and speed control means positionable on the second portion of the first housing means, the speed control means for controlling a speed of actuation of the load device independently of a speed of actuation of the valve spool, while supplying fluid pressure to the load device and while removing fluid pressure from the load device, wherein the speed control means includes shuttle ball check means for selectively switching between a first position and a second position in response to fluid pressure to control the speed of actuation of the load device during application of pressurized fluid to the load device and during evacuation of pressurized fluid from the load device.

9. The apparatus of claim 8 further comprising:

means for monitoring at least one parameter corresponding to operation of the valve spool to determine if the valve spool has moved completely from the first position to the second position, the monitoring means for generating a signal corresponding to the monitored parameter of operation.

10. The apparatus of claim 8 further comprising:

pressure sensing means for measuring pressure of the pressurized fluid in the second passage of the first housing means to determine if the valve spool has moved from the first position to second position, the pressure sensing means for generating a signal corresponding to the sensed pressure of the pressurized fluid supplied to the load device.

11. The apparatus of claim 8 further comprising:

position sensing means disposed adjacent the valve spool for determining the position of the valve spool as the valve spool moves between the first position and second position, the position sensing means for generating a signal corresponding to the position of the valve spool.

12. The apparatus of claim 8 further comprising:

modular port means connectable to the first, second and third spaced portions of the external surface of the first housing means for connecting the first passage to the source of pressurized fluid, for connecting the second passage to the load device and for connecting the third passages to an exhaust port.

13. The apparatus of claim 8 further comprising:

the first housing means including an enlarged chamber formed therein defining an internal volume for suppressing pressure fluctuations from the source of pressurized fluid.

14. The apparatus of claim 8 further comprising:

second housing means connectable to the first housing means for defining a second longitudinally extending aperture coaxially aligned with the first aperture of the first housing means;

a piston connectable to the valve spool and engageable within the second aperture of the second housing means for driving the valve spool from the first position toward the second position, the piston defining an expandable chamber between the piston and the second housing means; and valve means in communication with the source of pressurized fluid for selectively controlling application of the source of pressurized fluid to move the valve spool from the first position to the second position, and for selectively exhausting pressurized fluid for permitting the biasing means to drive the valve spool from the second position toward the first position.

15. The apparatus of claim 8 wherein the speed control means further comprises:

control housing means having a first aperture extending therethrough and a second aperture in fluid communication with the first aperture, the first aperture connectable to the second passage of the first housing means at one end and connectable in fluid communication with the load device at an opposite end;

a reciprocal valve spool engageable within the second aperture and moveable between a first position substantially blocking passage of fluid through the first aperture and a second position allowing substantial fluid communication through the first aperture, the reciprocal valve spool having a piston portion defining an expandable chamber between the piston portion and the second aperture of the control housing means; and biasing means for urging the reciprocal valve toward the first position.

16. The apparatus of claim 15 further comprising:

an adjustable valve for controlling the rate of pressurized fluid flow from the second passage of the first housing means to the expandable chamber of the piston portion of the reciprocal valve spool to drive the reciprocal valve spool from the first position toward the second position at a controlled speed of actuation.

17. An apparatus for selectively supplying a source of pressurized fluid to a load device and for selectively exhausting pressurized fluid from the load device comprising:

first housing means for defining a first longitudinally extending aperture communicating through first, second, and third passages with spaced first, second and third portions respectively of an external surface of the first housing means;

a valve spool engageable within the first aperture of the first housing means and longitudinally moveable therein between a first position communicating the second passage with the third passage and a second position communicating the first passage with the second passage;

means for biasing the valve spool toward the first position;

speed control means positionable on the second portion of the first housing means, the speed control means for controlling a speed of actuation of the load device;

second housing means connectable to the first housing means for defining a second longitudinally extending aperture coaxially aligned with the first aperture of the first housing means;

a piston connectable to the valve spool and engageable within the second aperture of the second housing means for driving the valve spool from the first position toward the second position, the piston defining an expandable chamber between the piston and the second housing means;

valve means in communication with the source of pressurized fluid for selectively controlling application of the source of pressurized fluid to move the valve spool from the first position to the second position, and for selectively exhausting pressurized fluid for permitting the biasing means to drive the valve spool from the second position toward the first position; and wherein the speed control means includes third housing means having a first aperture extending therethrough and a second aperture in fluid communication with the first aperture, the first aperture connectable to the second passage of the first housing means at one end and connectable in fluid communication with the load device at an opposite end, a reciprocal valve spool engageable within the second aperture and moveable between a first position substantially blocking passage of fluid through the first aperture and a second position allowing substantial fluid communication through the first aperture, the reciprocal valve spool having a piston portion defining an expandable chamber between the piston portion and the second aperture of the third housing means, and biasing means for urging the reciprocal valve toward the first position, an adjustable valve for controlling the rate of pressurized fluid flow from the second passage of the first housing means to the expandable chamber of the piston portion of the reciprocal valve spool to drive the reciprocal valve spool from the first position toward the second position at a controlled speed of actuation, and shuttle ball check means for selectively switching between a first connection of the expandable chamber of the piston portion of the reciprocal valve spool with the adjustable valve and a second connection of the expandable chamber of the piston portion of the reciprocal valve spool with the load device.

18. In a 3-way pilot operated control valve for selectively supplying a source of pressurized fluid to a load device and for selectively exhausting pressurized fluid from the load device, the improvement comprising:

first housing means for defining a first longitudinally extending aperture communicating through first, second, and third passages with spaced first, second and third portions respectively of an external surface of the first housing means;

a valve spool engageable within the first aperture of the first housing means and longitudinally moveable therein between a first position communicating the second passage with the third passage and a second position communicating the first passage with the second passage;

means for biasing the valve spool toward the first position;

modular port means connectable to the first, second and third spaced portions of the external surface of the first housing means for connecting the first passage to the source of pressurized fluid, for connecting the second passage to the load device, and for connecting the third passage to an exhaust port;

means for monitoring parameters corresponding to pressure and position during operation of the valve spool to determine if the valve spool has moved completely from the first position to the second position, the monitoring means for generating signals corresponding to the monitored parameters of operation; and speed control means positionable on the second portion of the first housing means interposed between the first housing means and the modular port means for the second passage, the speed control means for controlling a speed of actuation of the load device independently of a speed of actuation of the valve spool, while supplying fluid pressure to the load device and while removing fluid pressure from the load device, wherein the speed control means includes shuttle ball check means for selectively switching between a first position and a second position in response to fluid pressure to control the speed of actuation of the load device during application of pressurized fluid to the load device and during evacuation of pressurized fluid from the load device.

* * * * *